US012342891B2

(12) United States Patent
Zhang et al.

(10) Patent No.: US 12,342,891 B2
(45) Date of Patent: Jul. 1, 2025

(54) FALSE EYELASH MANUFACTURING PROCESS AND PROCESSING DEVICE

(71) Applicant: Qingdao Baisi Yijia Cosmetics Co., Ltd, Qingdao (CN)

(72) Inventors: Xiaoyan Zhang, Qingdao (CN); Zhaozhong Zhang, Qingdao (CN)

(73) Assignee: Qingdao Baisi Yijia Cosmetics Co., Ltd, Qingdao (CN)

( * ) Notice: Subject to any disclaimer, the term of this patent is extended or adjusted under 35 U.S.C. 154(b) by 0 days.

(21) Appl. No.: 18/918,019

(22) Filed: Oct. 16, 2024

(65) Prior Publication Data

US 2025/0064159 A1 Feb. 27, 2025

(30) Foreign Application Priority Data

Aug. 19, 2024 (CN) ..... 202411137554.6

(51) Int. Cl.
*A41G 5/02* (2006.01)

(52) U.S. Cl.
CPC ..... *A41G 5/02* (2013.01)

(58) Field of Classification Search
CPC ..... A41G 5/02
See application file for complete search history.

(56) References Cited

U.S. PATENT DOCUMENTS 11,986,037 B1 * 5/2024 Yu ..... A41G 5/02
2005/0061341 A1 * 3/2005 Choe ..... A41G 5/02 132/53

FOREIGN PATENT DOCUMENTS

CN 214111296 U 9/2021
CN 220723079 U * 4/2024

* cited by examiner

*Primary Examiner* — Mohammad M Ameen

(57) ABSTRACT

The invention relates to the technical field of false eyelash processing, and is particularly an improved false eyelash manufacturing process and processing device. The process comprises the following steps of: S1: obtaining an auxiliary film by a laser forming machine or a 3D printing film forming process; and S2: bending and shaping a tip part of an eyelash filament by a vacuum negative-pressure shaping method to obtain an eyelash filament with a curved tip part. According to the invention, a thread in an existing manufacturing process is replaced with the auxiliary film, so that compared with the thread, the auxiliary film has no greater elasticity, thus lowering operation requirements, making the manufacturing of false eyelashes more stable, and improving the production efficiency of false eyelashes.

5 Claims, 8 Drawing Sheets

FALSE EYELASH MANUFACTURING PROCESS AND PROCESSING DEVICE

CROSS-REFERENCE TO RELATED APPLICATIONS

This application claims foreign priority of Chinese Patent Application No. 202411137554.6, filed on Aug. 19, 2024 in the China National Intellectual Property Administration, the disclosures of all of which are hereby incorporated by reference.

TECHNICAL FIELD

The present invention relates to the technical field of false eyelash processing, and is particularly an improved false eyelash manufacturing process and processing device.

BACKGROUND OF THE PRESENT INVENTION

In recent years, because of the convenient and beautiful characteristics, false eyelashes have become more and more popular among women and become an essential cosmetic product for women to make up. Because of the requirement of processing accuracy, the false eyelashes are generally manufactured and processed manually. Specifically, an eyelash filament at a certain inclination angle is adhered to an adhesive tape to form a half eyelash filament sheet first, two half eyelash filament sheets are adhered relatively to form a whole eyelash filament sheet, then one thread is straightened and fixed on a die, the whole eyelash filament sheet is placed on the thread for fixing, the other thread is placed on the other side of the whole eyelash filament sheet and fixed, then two surfaces of the whole eyelash filament sheet are glued along the two threads to form a semi-finished product, and finally, after a fixing strap is adhered to the semi-finished product, a redundant part of the semi-finished product is cut off, and root cleaning is completed to form a finished product.

An existing false eyelash manufacturing and processing course has the following shortcomings: a. in the existing false eyelash manufacturing course, the threads in manufacturing materials need to be wound in advance, and loosened to use in the false eyelash manufacturing course, because a stress is generated during the winding of the threads, the threads are bent and deformed in the false eyelash manufacturing course, so that the threads need to be straightened and fixed by the die in the false eyelash manufacturing course, and the quality of formed false eyelashes may be affected if the threads are pulled too tightly or too loosely by the die, thus having a too high requirement for manual operation, causing manufacturing inconvenience, and affecting the production efficiency of false eyelashes; b. the threads, as eyelash stalks, need to be worn on an inner side of an eyelid, because cross sections of the threads are round, the threads occupy a large space on the inner side of the eyelid, resulting in poor comfort of users; c. in order to better fix the false eyelash sheet, two threads need to be laid in the existing false eyelash manufacturing course, so that the process is complicated, and the processing efficiency is low; d. the two threads in existing false eyelash manufacturing are located on two sides of the false eyelash sheet, so that the threads of the formed false eyelashes are exposed, which affects the appearance; and e. after the redundant part of the semi-finished product is cut off, redundant threads between clusters in the semi-finished product also need to be cut off, so that the processing steps were complicated, and requirements of different eye widths cannot be met.

SUMMARY OF THE PRESENT INVENTION

In order to make up for the shortcomings of the prior art, the present invention provides an improved false eyelash manufacturing process and processing device, and the process has the following advantages:

a. according to the present invention, a thread in an existing manufacturing process is replaced with an auxiliary film, so that compared with the thread, the auxiliary film has no greater elasticity, thus lowering operation requirements, making the manufacturing of false eyelashes more stable, and improving the production efficiency of false eyelashes; b. because a cross section of the strip-shaped auxiliary film is flat, an eyelash stalk formed after the auxiliary film is cut is flatter, which occupies a smaller space on an inner side of an eyelid, thus making a wearer more comfortable to wear; c. compared with an original process of laying two threads, the manufacturing of false eyelashes by utilizing the auxiliary film saves process steps, so that the improved process steps are simpler, and the processing efficiency is indirectly improved; d. the auxiliary film is located between two whole eyelash filament sheets, so that the formed eyelash stalk is more invisible, thus improving the aesthetics of the formed false eyelashes; and e. after the improved false eyelashes are manufactured, there is no need for cutting or selective cutting to meet requirements of different eye widths.

The technical solution used in the present invention to solve the technical problem is: an improved false eyelash manufacturing process of the present invention, wherein the process comprises the following steps of:

S1: obtaining an auxiliary film by a laser forming machine or a 3D printing film forming process;

S2: bending and shaping a tip part of an eyelash filament by a vacuum negative-pressure shaping method to obtain an eyelash filament with a curved tip part;

S3: adhering the eyelash filament in the S2 to an adhesive tape to form a half eyelash filament sheet, and then adhering two half eyelash filament sheets relatively to form a whole eyelash filament sheet;

S4: adhering the auxiliary film to one whole eyelash filament sheet, and adhering the other whole eyelash filament sheet to the other side of the auxiliary film to form a semi-finished product;

S5: gluing a position of the auxiliary film of the semi-finished product by a processing device; and

S6: cutting off a redundant part of the glued semi-finished product by a cutting tool, and taking a remaining part as a finished false eyelash product.

Preferably, in the S1, the step of obtaining the auxiliary film by the laser forming machine, comprises:

S11: placing an auxiliary film raw material to be cut on a positioning table for fixing;

S12: utilizing a high-energy laser beam generated by a laser cutting machine in the laser forming machine, and cutting the auxiliary film raw material according to a preset cutting path;

S13: cutting the auxiliary film according to the preset cutting path by the laser cutting machine to obtain an auxiliary film in a required shape; and

S14: carrying out quality inspection on the obtained auxiliary film.

Preferably, in the S1, the step of obtaining the auxiliary film by the 3D printing film forming process, comprises:

S1*a*: creating and importing a three-dimensional model of a required auxiliary film by computer software;

S1*b*: cutting the three-dimensional model of the auxiliary film into a thin layer with a standard thickness of the auxiliary film; and S1*c*: presetting a high-temperature resistant release film on a working table of a 3D printer, and then starting up the 3D printer to print layer by layer according to a number of thin layers to obtain the required auxiliary film.

Preferably, a shape of the auxiliary film comprises a strip, a block, a flake and a filament.

Preferably, in the S2, the step of bending and shaping the tip part of the eyelash filament by the vacuum negative-pressure shaping method, comprises:

S21: placing the eyelash filament into a female die, wherein a bottom portion of the female die is provided with an air extraction port, and then pressing a male die above the female die to form a complete die;

S22: communicating an air extraction end of an air pump with the air extraction port at the bottom portion of the female die, and extracting air in an interior of the assembled die, so that the interior of the die is relatively vacuum, which enables the eyelash filament to be attached to a surface of the die; and S23: physically bending and shaping the tip part of the eyelash filament by utilizing shapes of the female die and the male die in a relative vacuum environment.

An improved false eyelash processing device is provided, wherein the device is suitable for the improved false eyelash manufacturing process above, and comprises a gluing base and a glue box at a tail portion of the gluing base; two gluing bases are strip-shaped, and have a head specification smaller than a tail specification; one surfaces of the two gluing bases close to each other are provided with strip-shaped gluing grooves; a tail portion of one gluing base is provided with a threaded hole; the threaded hole is threadedly connected with the glue box; a tail portion of the glue box is open, and an inner side is slidably and hermetically connected with a box cover; one surfaces of the two gluing bases close to each other are provided with siding grooves; one sliding groove is communicated with the threaded hole, and a groove opening is fixedly connected with a sliding sleeve; the other end of the sliding sleeve is slidably and hermetically connected with the other sliding groove; the other end of the sliding sleeve is connected with a groove bottom of the other sliding groove through a first spring; the gluing groove is communicated with the sliding groove; and the semi-finished product is clamped by the two gluing bases and then glued by utilizing the glue box.

Preferably, the sliding groove is arranged to be closer to the glue box than the gluing groove; a driving groove is arranged in the gluing base; a driving plate is slidably and hermetically connected in the driving groove; one surfaces of the two driving plates far away from each other are fixedly connected with driving blocks; the driving block penetrates through the gluing base to extend to the outside; the driving block is slidably and hermetically connected with the gluing base; one ends of two driving blocks far away from each other are fixedly connected with pressing plates; one surfaces of the pressing plates close to each other are connected with corresponding gluing bases through second springs; the driving plate divides an internal space of the driving groove into a cavity with block and a cavity without block; the driving block is located in the cavity with block; the cavity with block is communicated with the corresponding sliding groove through a unidirectional feed hole; the driving plate is provided with a unidirectional discharge hole in a penetrated way; and the cavity without block is communicated with the groove bottom of the gluing groove through a communication hole.

Preferably, an elastic force of the first spring is smaller than that of the second spring; and the driving plate moves in the driving groove after the two gluing bases make contact with each other.

Preferably, the gluing base and the glue box are both made of a transparent material; a plurality of communication holes are provided; and the plurality of communication holes are dispersed in a length direction of the gluing groove.

Preferably, one surfaces of the two gluing bases close to each other are provided with rotating grooves; a gear is rotatably connected in the rotating groove; a glue collecting rod is rotatably connected in the gluing groove; one end of the glue collecting rod extends into the rotating groove and is fixedly connected with the gear; one surfaces of the two gluing bases close to each other are provided with tooth grooves; the tooth groove is communicated with the corresponding rotating groove; two tooth grooves are staggered with each other; one surfaces of the two gluing bases close to each other are fixedly connected with racks; an end portion of the rack is slidably connected in the corresponding tooth groove; the rack is meshed with the corresponding gear; and two racks enter corresponding tooth grooves when the two gluing bases approach each other.

Preferably, a groove wall of the gluing groove far away from the glue box is provided with an adjusting groove in a penetrated way; the adjusting groove is communicated with one surface of the gluing base which makes contact with the semi-finished product; an adjusting bar is slidably and hermetically connected in the adjusting groove; a width of the adjusting bar is the same as that of the gluing groove; one surface of the gluing base far away from the glue box is provided with a rectangular groove; a groove opening of the rectangular groove is slidably connected with a rectangular bar; an end portion of the rectangular bar is fixedly connected with an end portion of the adjusting bar through a connecting bar; a groove wall of the rectangular groove is provided with a first bolt in a penetrated way; and the first bolt makes contact with the rectangular bar under screwing.

Preferably, one surfaces of the two gluing bases far away from each other are provided with second bolts; an end portion of the second bolt extends into the corresponding driving groove; and the second bolt is threadedly and hermetically connected with the gluing base.

The present invention has the beneficial effects as follows.

1. According to the present invention, a thread in an existing manufacturing process is replaced with the auxiliary film, so that compared with the thread, the auxiliary film has no greater elasticity, thus lowering operation requirements, making the manufacturing of false eyelashes more stable, and improving the production efficiency of false eyelashes; because a cross section of the strip-shaped auxiliary film is flat, an eyelash stalk formed after the auxiliary film is cut is flatter, which occupies a smaller space on an inner side of an eyelid, thus making a wearer more comfortable to wear; compared with an original process of laying two threads, the manufacturing of false eyelashes by utilizing the auxiliary film saves process steps, so that the improved process steps are simpler, and the processing efficiency is indirectly improved; the auxiliary film is located between two whole eyelash filament sheets, so that the formed eyelash stalk is more invisible, thus improving the aesthetics of the formed false eyelashes; and after the improved false eyelashes are manufactured, there is no need for cutting or selective cutting to meet requirements of different eye widths.

2. According to the present invention, the two gluing bases drive the corresponding gluing grooves to be clamped on two sides of the semi-finished false eyelash product, so that straight-strip gluing is completed after the gluing grooves are filled with glue, which improves the gluing efficiency of the semi-finished product compared with the original way of gluing in sequence in a length direction of the auxiliary film, so that the processing efficiency of false eyelashes is improved.
3. According to the present invention, the pressing plates are pressed to drive the two gluing bases to approach each other, so that a double-sided gluing course of the semi-finished product may be completed during clamping, which improves the gluing convenience of the semi-finished product compared with the original gluing way, thus further improving the processing efficiency of false eyelashes, and achieving the characteristic of convenient operation at the same time.
4. In the present invention, the rack is driven to move out of the corresponding tooth groove when the gluing bases are far away from each other, the rack may drive the gear to rotate, the gear may drive the glue collecting rod in the gluing groove to rotate, and during separation of the gluing groove from the semi-finished product, the rotation of the glue collecting rod can wind some drawing glue, so as to reduce the drawing situation of the glue adhered to the semi-finished product and the glue in the gluing groove, so that the glue in the gluing groove may be quickly disconnected from the glue adhered to the semi-finished product, thus improving a gluing effect.
5. In the present invention, the second bolt may enter the driving groove during screwing, and the end portion of the second bolt abuts against the driving plate, so that a resetting distance of the driving plate under the elastic force of the second spring is limited, and by controlling a length of the second bolt entering the driving groove, a moving range of the driving plate in the driving groove is changed, so that a single gluing amount in the gluing groove is controlled, thus being suitable for requirements of different gluing amounts.

DESCRIPTION OF THE DRAWINGS

The present invention is further described hereinafter with reference to the drawings and embodiments.

Figure 1:
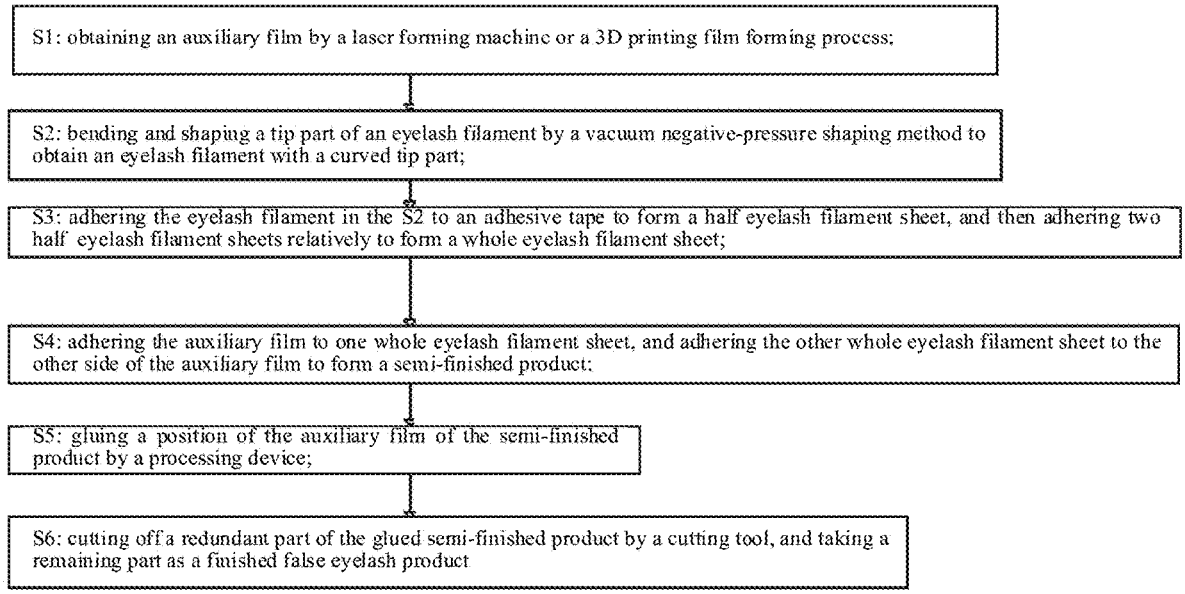
FIG. 1 is a process flow diagram of the present invention.
Figure 2:
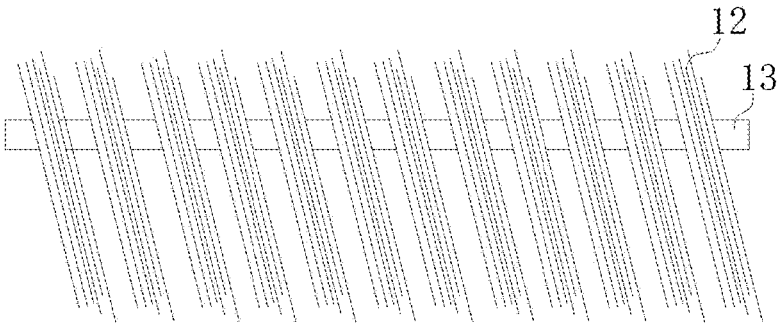
FIG. 2 is a schematic diagram of a half eyelash filament sheet (a tip part of an eyelash filament is not curved) in the present invention.
Figure 3:
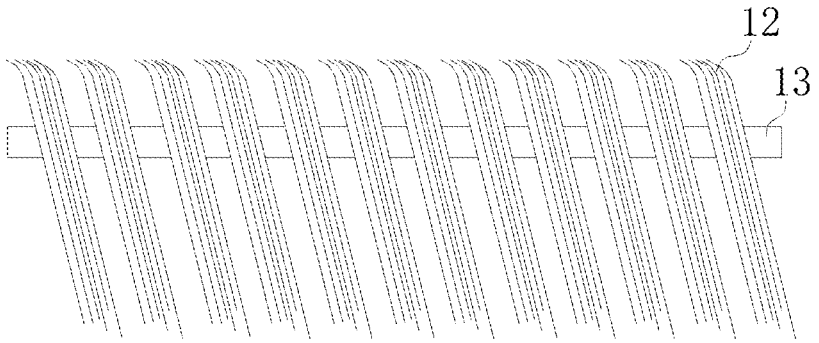
FIG. 3 is a schematic diagram of the half eyelash filament sheet (the tip part of the eyelash filament is curved) in the present invention.
Figure 4:
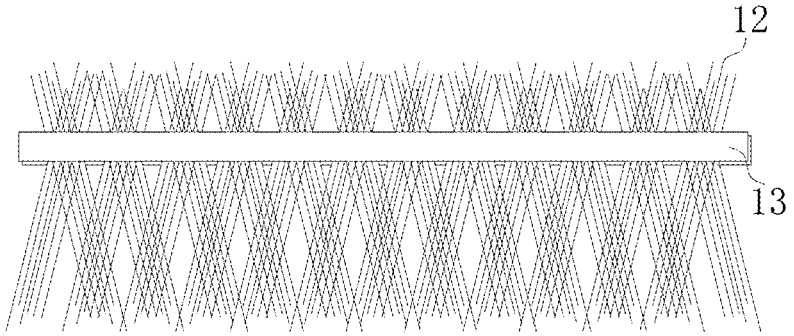
FIG. 4 is a schematic diagram of a whole eyelash filament sheet in the present invention.
Figure 5:
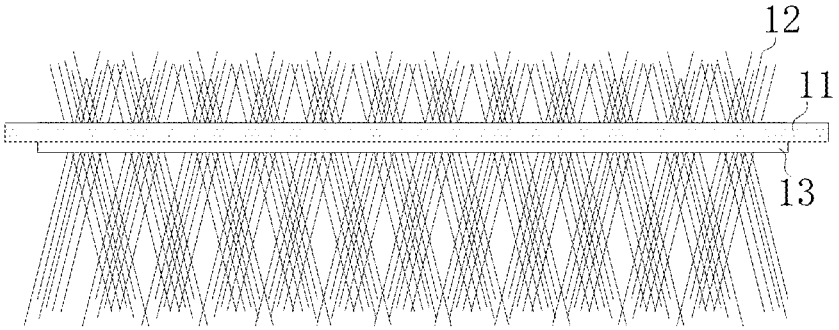
FIG. 5 is a schematic diagram of an auxiliary film adhered to one side of a single whole eyelash filament sheet in the present invention.
Figure 6:
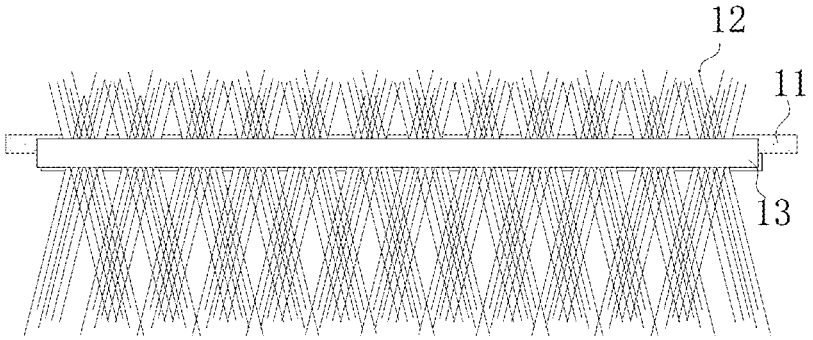
FIG. 6 is a schematic diagram of a semi-finished product in the present invention.
Figure 7:
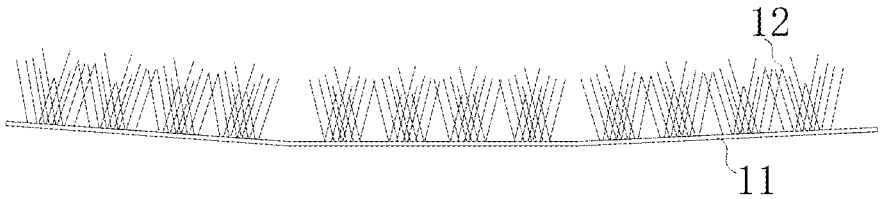
FIG. 7 is a structure diagram of a finished product in the present invention.
Figure 8:
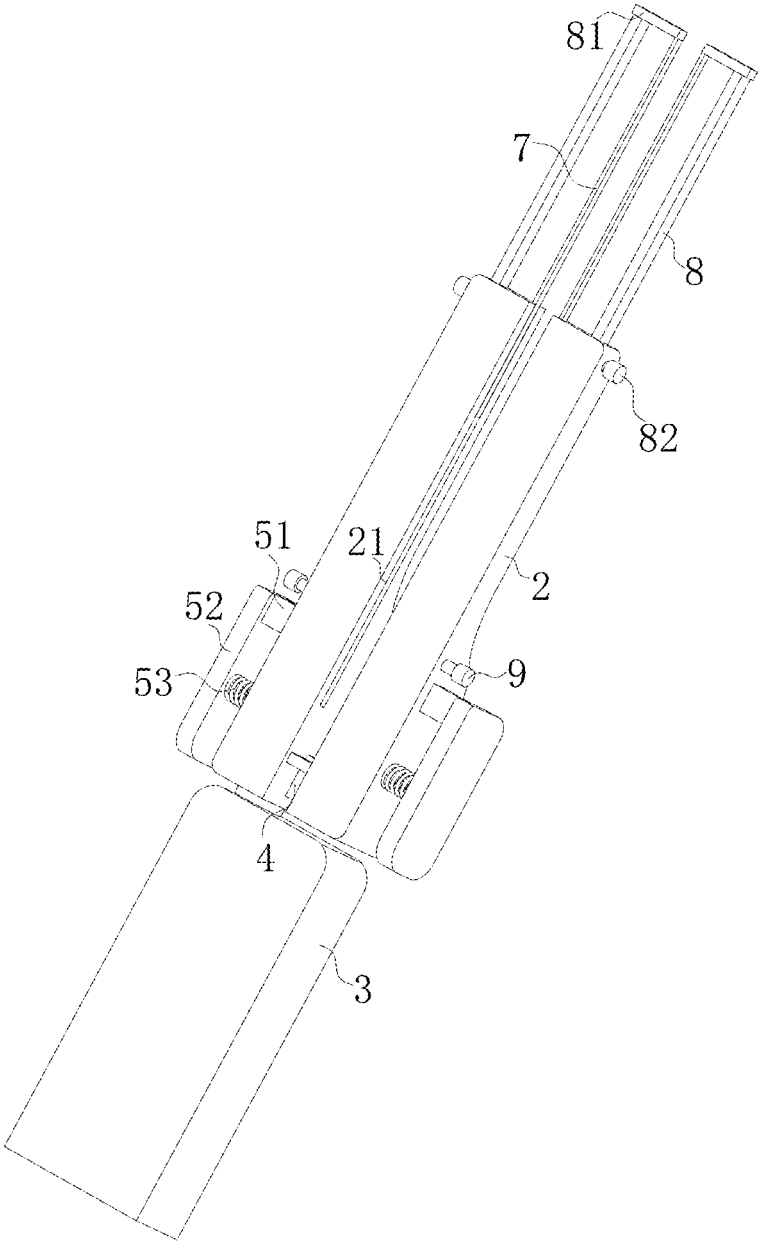
FIG. 8 is a stereoscopic view of a processing device in the present invention from one perspective.
Figure 9:
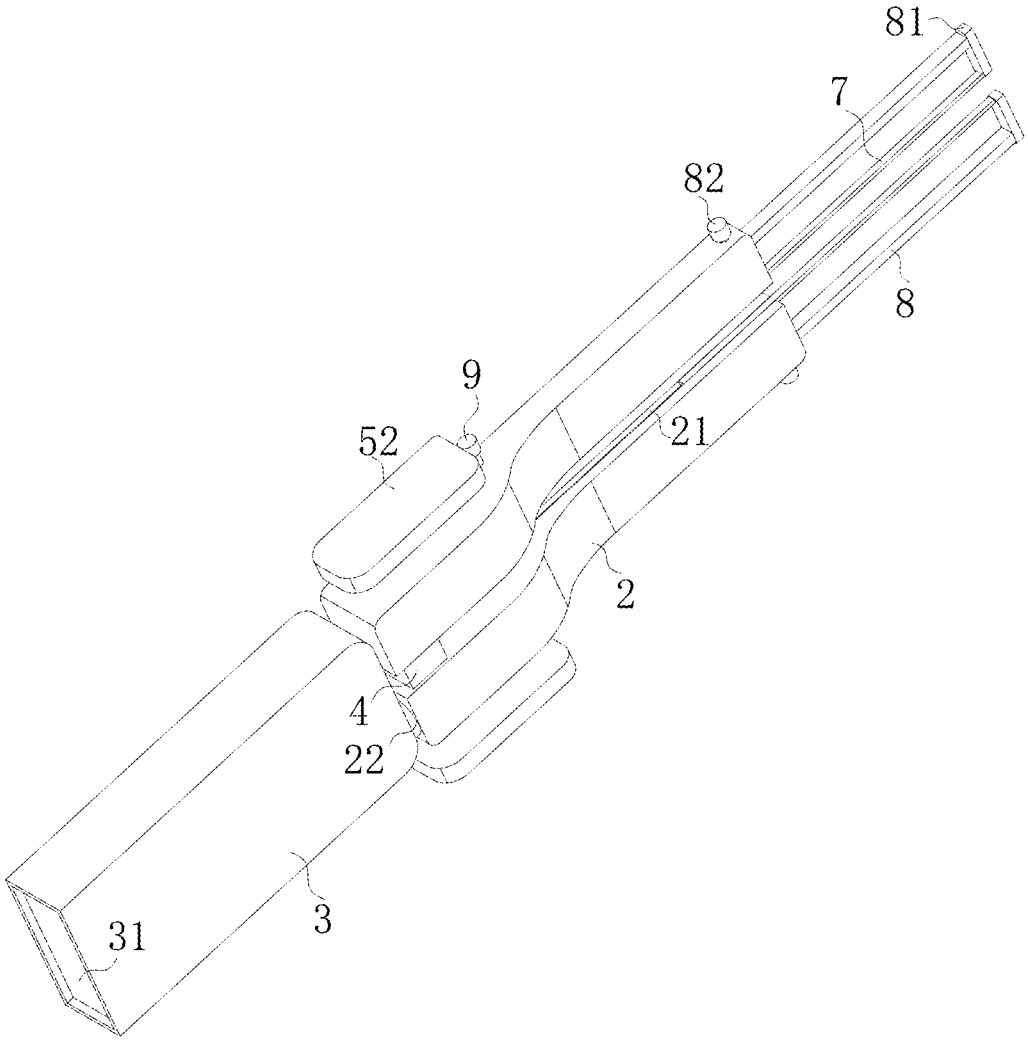
FIG. 9 is a stereoscopic view of the processing device in the present invention from another perspective.
Figure 10:
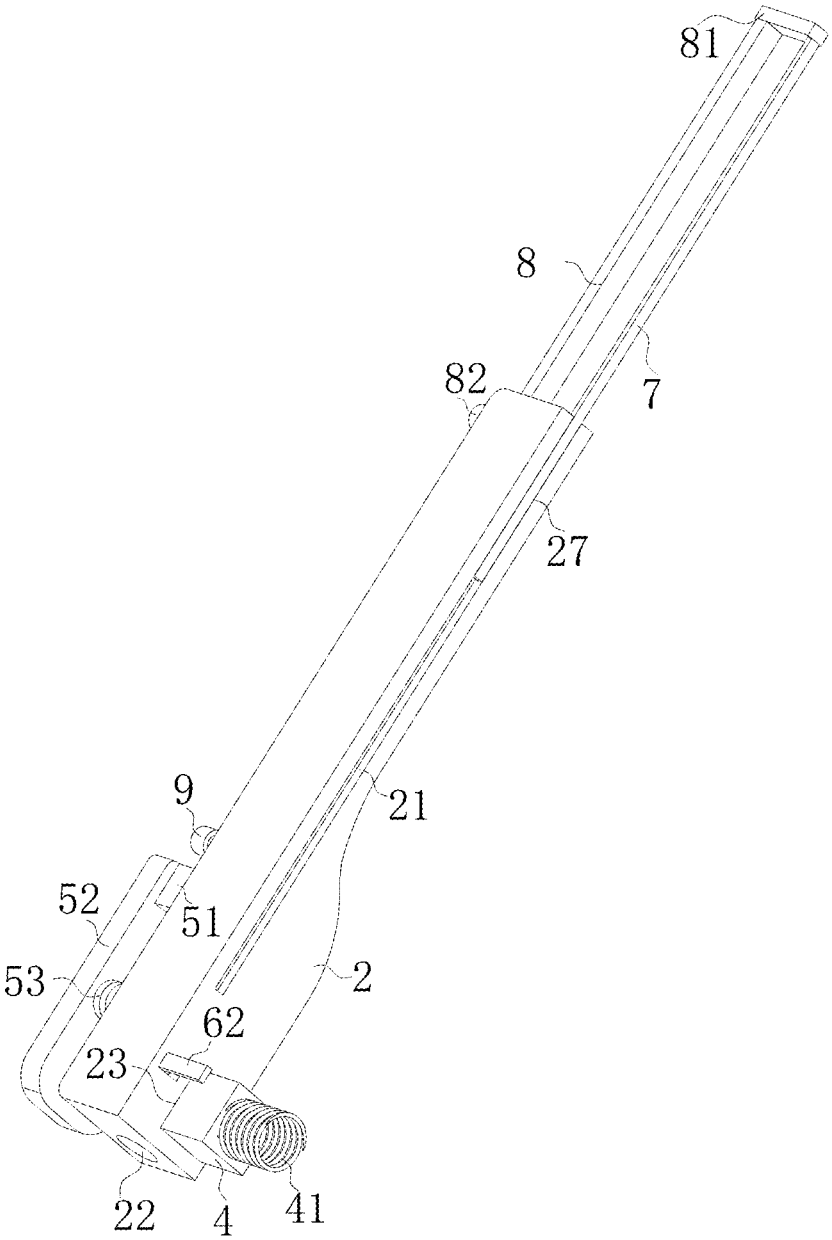
FIG. 10 is a stereoscopic view of a single gluing base in the present invention.
Figure 11:
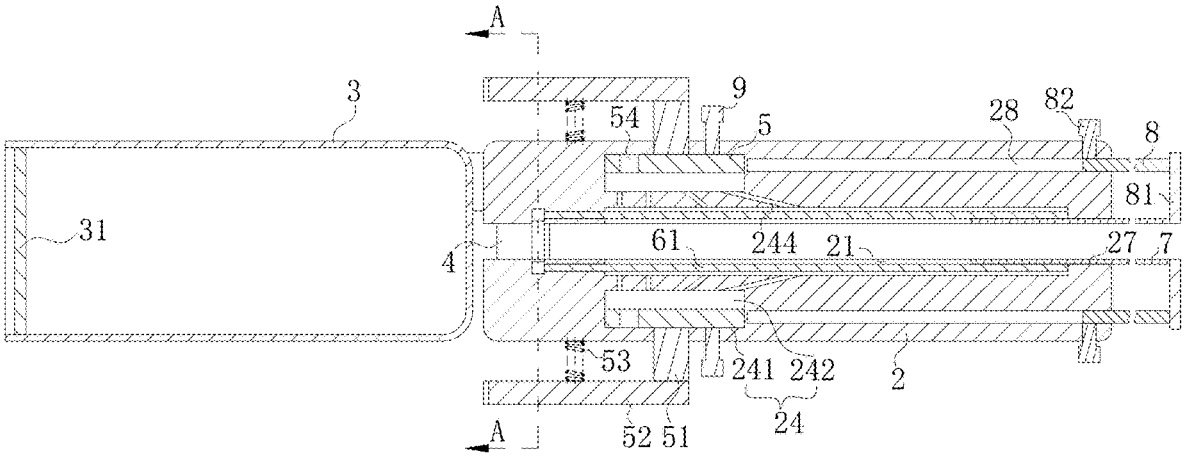
FIG. 11 is a sectional view of the present invention.
Figure 12:
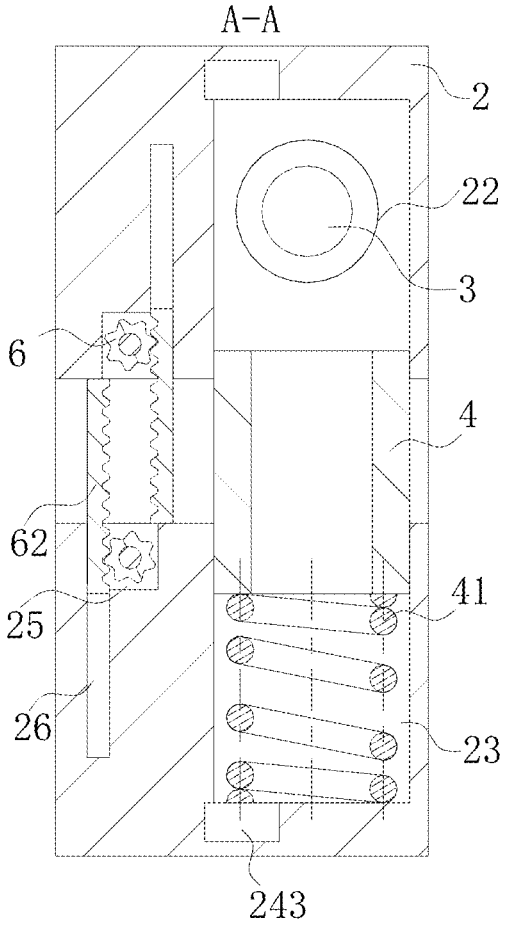
FIG. 12 is a sectional view of a part A-A in FIG. 11.

In the drawings: 11 refers to auxiliary film, 12 refers to eyelash filament, 13 refers to adhesive tape, 2 refers to gluing base, 21 refers to gluing groove, 22 refers to threaded hole, 23 refers to sliding groove, 24 refers to driving groove, 241 refers to cavity with block, 242 refers to cavity without block, 243 refers to unidirectional feed hole, 244 refers to communication hole, 25 refers to rotating groove, 26 refers to tooth groove, 27 refers to adjusting groove, 28 refers to rectangular groove, 3 refers to glue box, 31 refers to box cover, 4 refers to sliding sleeve, 41 refers to first spring, 5 refers to driving plate, 51 refers to driving block, 52 refers to pressing plate, 53 refers to second spring, 54 refers to unidirectional discharge hole, 6 refers to gear, 61 refers to glue collecting rod, 62 refers to rack, 7 refers to adjusting bar, 8 refers to rectangular bar, 81 refers to connecting bar, 82 refers to first bolt, and 9 refers to second bolt.

DETAILED DESCRIPTION OF PREFERRED EMBODIMENTS

In order to make the technical means, creative features, objects and effects of the present invention easy to understand, the present invention is further described hereinafter with reference to specific embodiments.

Embodiment 1: as shown in FIG. 1 to FIG. 2 and FIG. 4 to FIG. 12, an improved false eyelash manufacturing process is provided, wherein the process comprises the following steps of:

- S1: cutting an auxiliary film 11 into strips by a laser forming machine;
- S2: adhering an eyelash filament 12 to an adhesive tape 13 to form a half eyelash filament sheet, and then adhering two half eyelash filament sheets relatively to form a whole eyelash filament sheet;
- S3: adhering the auxiliary film 11 to one whole eyelash filament sheet, and adhering the other whole eyelash filament sheet to the other side of the auxiliary film 11 to form a semi-finished product;
- S4: gluing a position of the auxiliary film 11 of the semi-finished product by a processing device; and
- S5: cutting off a redundant part of the glued semi-finished product by a cutting tool, and taking a remaining part as a finished false eyelash product.

The auxiliary film 11 is cut into the strips by the laser forming machine, the auxiliary film 11 is a paper or polyester film, and the auxiliary film 11 formed by the laser forming machine has poor elasticity, which is convenient to use. In addition, a thickness of the auxiliary film 11 is 0.001 mm to 0.3 mm, a width of the auxiliary film may be selected at will, and the auxiliary film may be flat or flaky, and may be transparent, black, gray or any color, so as to satisfy different applicable people.

When starting to manufacture false eyelashes, the eyelash filament 12 at a certain inclination angle is adhered to the adhesive tape 13 first to form the half eyelash filament sheet, and then two half eyelash filament sheets are adhered relatively to form the whole eyelash filament sheet. It should be noted that two eyelash filaments 12 are interlaced with each other, so that the formed false eyelashes are more beautiful and denser. Then, the auxiliary film 11 is adhered to one whole eyelash filament sheet, and the other whole eyelash filament sheet is adhered to the other side of the auxiliary film 11, so that the auxiliary film 11 is sandwiched between the two whole eyelash filament sheets. The auxiliary film 11 may fix the two whole eyelash filament sheets and the single auxiliary film 11 by self-adhesion or an additional adhesive material to form the semi-finished product, and then, the position of the auxiliary film 11 of the semi-finished product is glued in a length direction of the auxiliary film 11 and close to an upper edge. After gluing, the redundant part is cut off at about 0.5 mm of the auxiliary film 11 with a blade to form the finished false eyelash product, and a distance between the upper edge of the auxiliary film 11 and a top portion of the eyelash filament sheet is a length of the finished false eyelash product. A cutting width of the auxiliary film 11 may be changed as required to satisfy different eyelid depths.

Compared with an existing false eyelash manufacturing process, the present invention has the following advantages:

a. according to the present invention, a thread in the existing manufacturing process is replaced with the auxiliary film 11, so that compared with the thread, the auxiliary film 11 has no greater elasticity, thus lowering operation requirements, making the manufacturing of false eyelashes more stable, and improving the production efficiency of false eyelashes; b. because a cross section of the strip-shaped auxiliary film 11 is flat, an eyelash stalk formed after the auxiliary film 11 is cut is flatter, which occupies a smaller space on an inner side of an eyelid, thus making a wearer more comfortable to wear; c. compared with an original process of laying two threads, the manufacturing of false eyelashes by utilizing the auxiliary film 11 saves process steps, so that the improved process steps are simpler, and the processing efficiency is indirectly improved; d. the auxiliary film 11 is located between two whole eyelash filament sheets, so that the formed eyelash stalk is more invisible, thus improving the aesthetics of the formed false eyelashes; and e. after the improved false eyelashes are manufactured, there is no need for cutting or selective cutting to meet requirements of different eye widths.

Embodiment 2: as shown in FIG. 1, FIG. 3 and FIG. 4 to FIG. 15, different from Embodiment 1, Embodiment 2 enriches production lines of false eyelash processing to meet processing requirements of different types of false eyelashes, and specifically comprises the following steps of:

S1: obtaining an auxiliary film by a laser forming machine or a 3D printing film forming process;

S2: bending and shaping a tip part of an eyelash filament by a vacuum negative-pressure shaping method to obtain an eyelash filament with a curved tip part;

S3: adhering the eyelash filament in the S2 to an adhesive tape to form a half eyelash filament sheet, and then adhering two half eyelash filament sheets relatively to form a whole eyelash filament sheet;

S4: adhering the auxiliary film to one whole eyelash filament sheet, and adhering the other whole eyelash filament sheet to the other side of the auxiliary film to form a semi-finished product;

S5: gluing a position of the auxiliary film of the semi-finished product by a processing device; and S6: cutting off a redundant part of the glued semi-finished product by a cutting tool, and taking a remaining part as a finished false eyelash product.

Specifically, in the S1, the step of obtaining the auxiliary film by the laser forming machine, comprises:

S11: placing an auxiliary film raw material to be cut on a positioning table for fixing, wherein a fixing way comprises, but is not limited to, pressing fixation, magnetic attraction fixation, clamping fixation, and the like;

S12: utilizing a high-energy laser beam generated by a laser cutting machine in the laser forming machine, and cutting the auxiliary film raw material according to a preset cutting path, wherein it should be noted that an intensity and a moving speed of a laser beam may be adjusted as required to ensure cutting accuracy and speed, and before cutting, the adjustment needs to be carried out according to a material characteristic of the auxiliary film and a shape of the required auxiliary film, which comprises setting laser power, the cutting speed, and whether auxiliary gas (such as oxygen) is needed to assist in material combustion;

S13: cutting the auxiliary film according to the preset cutting path by the laser cutting machine to obtain an auxiliary film in a required shape; and S14: carrying out quality inspection on the obtained auxiliary film, wherein it should be noted that this step is intended to ensure that the accuracy, shape and smoothness of the obtained auxiliary film all meet the requirements, and if the accuracy, shape and smoothness of the obtained auxiliary film do not meet the requirements, parameters of the laser forming machine may be adjusted to ensure that the obtained auxiliary film is qualified.

Specifically, in the S1, the step of obtaining the auxiliary film by the 3D printing film forming process, comprises:

S1*a*: creating and importing a three-dimensional model of a required auxiliary film by computer software, wherein this model will be used as a working instruction of a 3D printer to guide the 3D printer to construct an object by accumulating materials layer by layer;

S1*b*: cutting the three-dimensional model of the auxiliary film into a thin layer with a standard thickness of the auxiliary film, wherein these thin layers are layers to be printed one by one by the 3D printer, and each layer has a detailed instruction to instruct the 3D printer how much material should be deposited on this layer; and S1*c*: presetting a high-temperature resistant release film on a working table of a 3D printer, and then starting up the 3D printer to print layer by layer according to a number of thin layers to obtain the required auxiliary film.

Specifically, the shape of the auxiliary film comprises a strip, a block, a flake and a filament. During acquisition of the auxiliary film by the laser forming machine or the 3D printing film forming process, auxiliary films with different shapes may be selected according to types of processed false eyelashes.

In some embodiments, the shape of the auxiliary film is the block, which is intended to bear more eyelash filaments, so that the false eyelashes obtained subsequently are dense multi-cluster false eyelashes.

In some embodiments, the shape of the auxiliary film is the flake, which is not only intended to bear more eyelash filaments, so that the false eyelashes obtained subsequently are dense multi-cluster false eyelashes, but also intended to make the flaky auxiliary film easier to fit an eye corner, so that wearing comfort is improved.

In some embodiments, the shape of the auxiliary film is the filament, which is intended to make the false eyelashes obtained subsequently more invisible.

Certainly, the shape of the auxiliary film in the present invention is not limited to the above shapes, and designers may obtain more shapes of the auxiliary film, such as a wave and a stack, by the laser forming machine or the 3D printing film forming process according to research results of the marketing department, thus increasing the types of the false eyelashes.

Specifically, in the S2, the step of bending and shaping the tip part of the eyelash filament by the vacuum negative-pressure shaping method, comprises:

S21: placing the eyelash filament into a female die, wherein a bottom portion of the female die is provided with an air extraction port, and then pressing a male die above the female die to form a complete die;

S22: communicating an air extraction end of an air pump with the air extraction port at the bottom portion of the female die, and extracting air in an interior of the assembled die, so that the interior of the die is relatively vacuum, which enables the eyelash filament to be attached to a surface of the die; and S23: physically bending and shaping the tip part of the eyelash filament by utilizing shapes of the female die and the male die in a relative vacuum environment.

Figure 13:
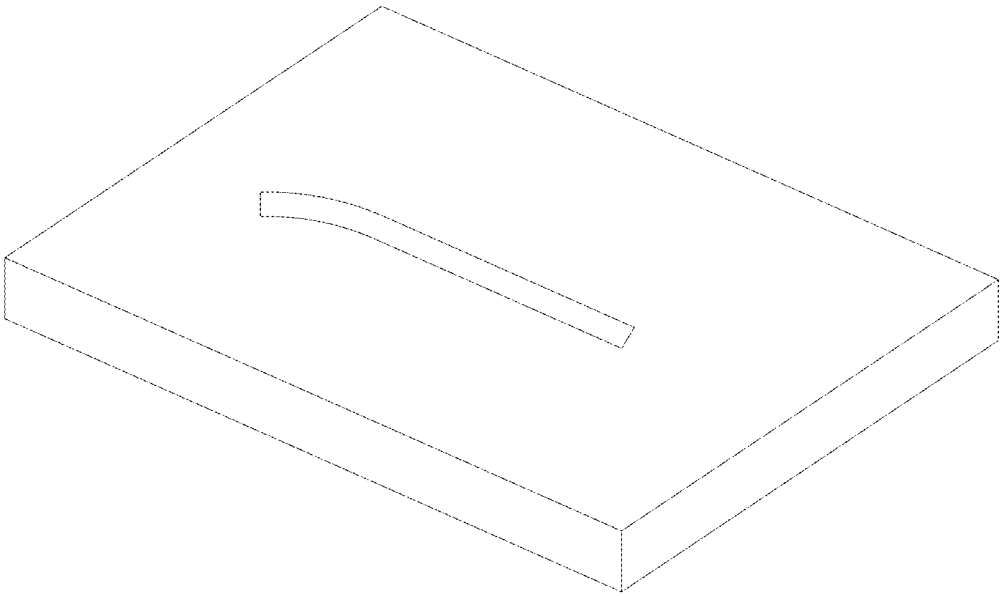
FIG. 13 is a schematic structural diagram of a female die in the present invention.
Figure 14:
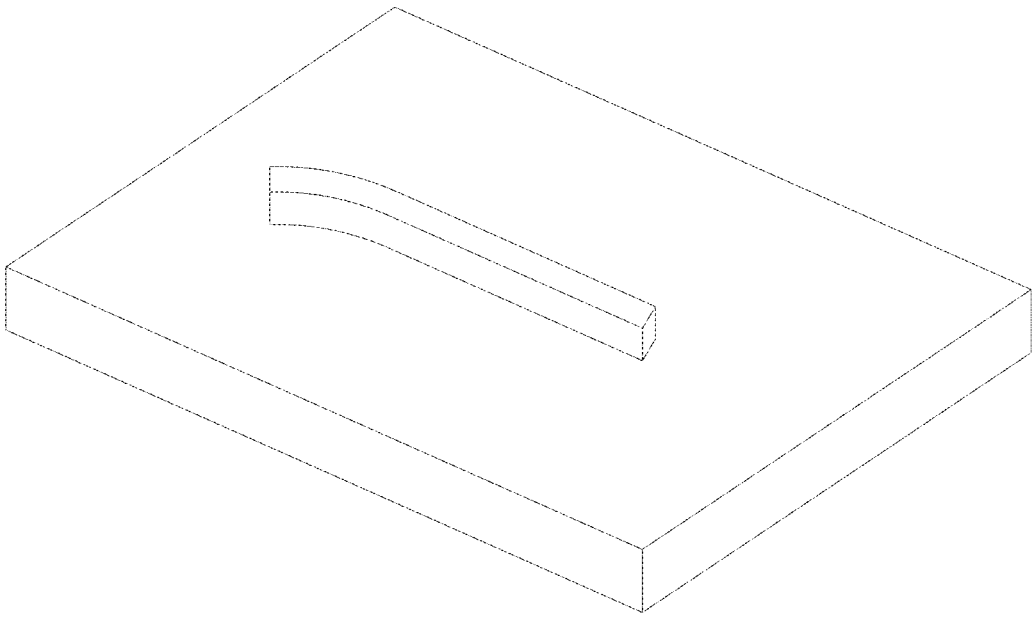
FIG. 14 is a schematic structural diagram of a male die in the present invention.

Specifically, the die referred to in the present invention is a component for bending and shaping the eyelash filament. If the demand to be achieved in the present invention is the curved tip part of the eyelash filament, the shape of the female die for placing the eyelash filament in the die is as shown in FIG. 13 and the shape of the male die is as shown in FIG. 14. After embedding a single eyelash filament or a whole cluster of eyelash filaments into the female die and the male die, the eyelash filament may be physically shaped preliminarily, and then a subsequent air extraction step is carried out, so that a fitting degree of the eyelash filament in the female die and the male die after die assembly is further improved, which is beneficial for improving a physical bending and shaping effect of the tip part of the eyelash filament.

Figure 15:
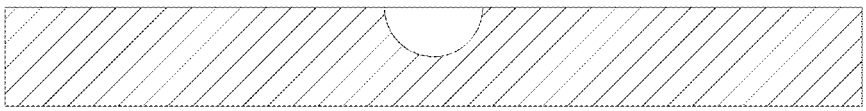
FIG. 15 is a sectional view of the female die in the present invention.

Furthermore, in a similar fashion, tip parts of eyelash filaments with different bending degrees may be obtained according to the steps S21 to S23 in the present invention. Therefore, it is only necessary to design dies with different shapes. Moreover, the present invention is not limited to that the cross section of the female die is a semi-circular groove as shown in FIG. 15, and the shape of the cross section of the female die may be set according to actual needs of designers, such as an ellipse and a rectangle. When the shape of the cross section of the female die is changed, the shape of the cross section of the male die needs to be changed synchronously to correspond to the female die, so that the present invention can not only manufacture the false eyelashes in batches, but also manufacture the false eyelashes with different shapes in batches.

Certainly, the step S2 may not be used in the present invention, that is, in some situations where the false eyelashes are needed, there is no need for the eyelash filament with the curved tip part, for example, in performance activities where people pretend to be animals, the false eyelashes worn by performers are linear, or some people like linear false eyelashes, at this time, the step S2 may not be used, which does not affect the manufacturing of false eyelashes in the present invention.

Embodiment 3: an improved false eyelash processing device is provided, wherein the device is suitable for the improved false eyelash manufacturing process above, and comprises a gluing base 2 and a glue box 3 at a tail portion of the gluing base 2; two gluing bases 2 are strip-shaped, and have a head specification smaller than a tail specification; one surfaces of the two gluing bases 2 close to each other are provided with strip-shaped gluing grooves 21; a tail portion of one gluing base 2 is provided with a threaded hole 22; the threaded hole 22 is threadedly connected with the glue box 3; a tail portion of the glue box 3 is open, and an inner side is slidably and hermetically connected with a box cover 31; one surfaces of the two gluing bases 2 close to each other are provided with siding grooves 23; one sliding groove 23 is communicated with the threaded hole 22, and a groove opening is fixedly connected with a sliding sleeve 4; the other end of the sliding sleeve 4 is slidably and hermetically connected with the other sliding groove 23; the other end of the sliding sleeve 4 is connected with a groove bottom of the other sliding groove 23 through a first spring 41; the gluing groove 21 is communicated with the sliding groove 23; and the semi-finished product is clamped by the two gluing bases 2 and then glued by utilizing the glue box 3.

After the auxiliary film 11 is located on two whole eyelash filament sheets to form a semi-finished product, the two gluing bases 2 are held, then the semi-finished product is moved between the two gluing bases 2, an upper edge of the auxiliary film 11 in the semi-finished product corresponds to positions of the gluing grooves 21, and then the two gluing bases 2 are pressed to make the two gluing bases 2 close to each other, wherein the groove opening of the sliding groove 23 on one gluing base 2 is fixedly connected with the sliding sleeve 4, and the groove opening of the sliding groove 23 on the other gluing base 2 is slidably and hermetically connected with the sliding sleeve 4. Therefore, the sliding sleeve 4 may slide in the corresponding sliding groove 23 when the two gluing bases 2 approach each other, and the sliding sleeve 4 squeezes the corresponding first spring 41 during movement towards the groove bottom of the corresponding sliding groove 23, so that the first spring 41 is squeezed and compressed. Two corresponding gluing grooves 21 move close to each other with the activities of the gluing bases 2 until the two gluing bases 2 are clamped on two sides of the semi-finished product, the box cover 31 is pushed to squeeze glue in the glue box 3, the glue enters the sliding groove 23 along the threaded hole 22 under squeezing of the glue cover and finally flows into the gluing grooves 21, and air in the gluing grooves 21 is squeezed out. Because the gluing grooves 21 are strip-shaped, the glue may fill the gluing grooves 21 and make contact with the semi-finished product, and the gluing grooves 21 correspond to a to-be-glued position of the semi-finished product, so that the glue may make contact with the to-be-glued position of the semi-finished product after being injected into the gluing grooves 21. Subsequently, when the semi-finished product is held, a force for holding the two gluing bases 2 is reduced, so that the first spring 41 pushes the sliding sleeve 4 to slide out of the corresponding sliding groove 23, so as to make the two gluing bases 2 far away from each other. The gluing bases 2 may drive the gluing grooves 21 to be out of contact with the semi-finished product, and the glue in the gluing bases 2 may adhere to two sides of the semi-finished product, thus completing the gluing of the semi-finished product. After the glue in the glue box 3 is used up, the glue box will be unscrewed from the threaded hole 22 for replacement.

In this embodiment, the two gluing bases 2 drive the corresponding gluing grooves 21 to be clamped on two sides of the semi-finished false eyelash product, so that straight-strip gluing is completed after the gluing grooves 21 are filled with glue, which improves the gluing efficiency of the semi-finished product compared with the original way of gluing in sequence in a length direction of the auxiliary film 11, so that the processing efficiency of false eyelashes is improved.

Embodiment 4: the sliding groove 23 is arranged to be closer to the glue box 3 than the gluing groove 21; a driving groove 24 is arranged in the gluing base 2; a driving plate 5 is slidably and hermetically connected in the driving groove 24; one surfaces of the two driving plates 5 far away from each other are fixedly connected with driving blocks 51; the driving block 51 penetrates through the gluing base 2 to extend to the outside; the driving block 51 is slidably and hermetically connected with the gluing base 2; one ends of two driving blocks 51 far away from each other are fixedly connected with pressing plates 52; one surfaces of the pressing plates 52 close to each other are connected with corresponding gluing bases 2 through second springs 53; the driving plate 5 divides an internal space of the driving groove 24 into a cavity with block 241 and a cavity without block 242; the driving block 51 is located in the cavity with block 241; the cavity with block 241 is communicated with the corresponding sliding groove 23 through a unidirectional feed hole 243; the driving plate 5 is provided with a unidirectional discharge hole 54 in a penetrated way; and the cavity without block 242 is communicated with the groove bottom of the gluing groove 21 through a communication hole 244.

In this embodiment, an elastic force of the first spring 41 is smaller than that of the second spring 53; and the driving plate 5 moves in the driving groove 24 after the two gluing bases 2 make contact with each other.

In this embodiment, the gluing base 2 and the glue box 3 are both made of a transparent material; a plurality of communication holes 244 are provided; and the plurality of communication holes 244 are dispersed in a length direction of the gluing groove 21.

After the auxiliary film 11 is located between the two whole eyelash filament sheets to form the semi-finished product, the two gluing bases 2 are held, then the semi-finished product is moved between the two gluing bases 2, the upper edge of the auxiliary film 11 in the semi-finished product, which is namely the gluing position, corresponds to the positions of the gluing grooves 21, and then the two pressing plates 52 are pressed. Because the elastic force of the first spring 41 is far less than that of the second spring 53, the two pressing plates 52 may drive their respective gluing bases 2 to approach each other during the pressing of the two pressing plates 52, the sliding sleeve 4 may slide along the corresponding sliding groove 23 and squeeze the first spring 41 when the two gluing bases 2 approach each other, the two gluing bases 2 may clamp the semi-finished product when the two gluing bases 2 continue to approach each other, and then pressing forces on the two pressing plates 52 are increased, so that the two pressing plates 52 approach each other. The pressing plates 52 may squeeze the corresponding second springs 53 when approaching each other, the pressing plates 52 may drive the driving plates 5 to slide in the driving grooves 24 through the driving blocks 51, and spaces of the cavities with block 241 are enlarged to form negative pressures when the two driving plates 5 approach each other, so that the glue in the glue box 3 enters the cavities with block 241 along the threaded hole 22, the sliding grooves 23 and the unidirectional feed holes 243. The corresponding cavities without block 242 may be squeezed when the two driving plates 5 approach each other, so that the glue in the cavities without block 242 enters the gluing grooves 21 along the plurality of communication holes 244. Because the plurality of communication holes 244 are dispersed along the length directions of the gluing grooves 21, the glue is filled more fully and compactly in the gluing grooves 21, and the air in the gluing grooves 21 is squeezed out. The gluing base 2 and the glue box 3 are both transparent, which is convenient for an operator to observe. After the glue is filled in the gluing grooves 21, the glue in the gluing grooves 21 makes contact with the semi-finished product, so that the semi-finished product is glued on two sides at one time. After the glue makes contact with the semi-finished product, the pressing forces on the pressing plates 52 are reduced, the second springs 53 may be reset first, and the pressing plates 52 are driven to be far away from the corresponding gluing bases 2 during resetting of the second springs 53, so that the pressing plates 52 drive the driving plates 5 to move again in the driving grooves 24 through the driving blocks 51. The corresponding cavities with block 241 are squeezed when the two driving plates 5 are far away from each other, the glue in the cavities with block 241 enters the cavities without block 242 along the unidirectional discharge holes 54 for replenishment, the two gluing bases 2 may start to be far away from each other when the pressing forces on the pressing plates 52 continue to be reduced, the gluing bases 2 may be separated from the semi-finished product, strip-shaped glue remains on the semi-finished product to complete gluing, and the first spring 41 is released and reset to prepare for the gluing of the next semi-finished product.

In this embodiment, the pressing plates 52 are pressed to drive the two gluing bases 2 to approach each other, so that a double-sided gluing course of the semi-finished product may be completed during clamping, which improves the gluing convenience of the semi-finished product compared with the original gluing way, thus further improving the processing efficiency of false eyelashes, and achieving the characteristic of convenient operation at the same time.

Embodiment 5: one surfaces of the two gluing bases 2 close to each other are provided with rotating groove 25; a gear 6 is rotatably connected in the rotating groove 25; a glue collecting rod 61 is rotatably connected in the gluing groove 21; one end of the glue collecting rod 61 extends into the rotating groove 25 and is fixedly connected with the gear 6; one surfaces of the two gluing bases 2 close to each other are provided with tooth groove 26; the tooth groove 26 is communicated with the corresponding rotating groove 25; two tooth grooves 26 are staggered with each other; one surfaces of the two gluing bases 2 close to each other are fixedly connected with rack 62; an end portion of the rack 62 is slidably connected in the corresponding tooth groove 26; the rack 62 is meshed with the corresponding gear 6; and two racks 62 enter corresponding tooth grooves 26 when the two gluing bases 2 are close to each other.

The gluing bases 2 may drive their fixedly connected racks 62 to move when the two gluing bases 2 approach each other, the end portions of the racks 62 enter the corresponding tooth grooves 26 for avoidance, and the racks 62 may also drive the meshed gears 6 to rotate, so that the two gears 6 may both be driven by their corresponding racks 62 to rotate. The gears 6 may drive the glue collecting rods 61 to rotate during rotation, the glue collecting rods 61 may rotate in their respective gluing grooves 21, and after the semi-finished product is clamped by the two gluing bases 2, the glue is controlled to be injected into the gluing grooves 21, so that the glue makes contact with the semi-finished product after the gluing grooves 21 are filled with the glue to complete gluing. Subsequently, after the gluing bases 2 are released, the two gluing bases 2 are far away from each other. The rack 62 is driven to move out of the corresponding tooth groove 26 when the gluing bases 2 are far away from each other, the rack 62 may drive the gear 6 to rotate, the gear 6 may drive the glue collecting rod 61 in the gluing groove 21 to rotate, and during separation of the gluing groove 21 from the semi-finished product, the rotation of the glue collecting rod 61 can wind some drawing glue, so as to reduce the drawing situation of the glue adhered to the semi-finished product and the glue in the gluing groove 21, so that the glue in the gluing groove 21 may be quickly disconnected from the glue adhered to the semi-finished product, thus improving a gluing effect.

Embodiment 6: a groove wall of the gluing groove 21 far away from the glue box 3 is provided with an adjusting groove 27 in a penetrated way; the adjusting groove 27 is communicated with one surface of the gluing base 2 which makes contact with the semi-finished product; an adjusting bar 7 is slidably and hermetically connected in the adjusting groove 27; a width of the adjusting bar 7 is the same as that of the gluing groove 21; one surface of the gluing base 2 far away from the glue box 3 is provided with a rectangular groove 28; a groove opening of the rectangular groove 28 is slidably connected with a rectangular bar 8; an end portion of the rectangular bar 8 is fixedly connected with an end portion of the adjusting bar 7 through a connecting bar 81; a groove wall of the rectangular groove 28 is provided with a first bolt 82 in a penetrated way; and the first bolt 82 makes contact with the rectangular bar 8 under screwing.

In this embodiment, one surfaces of the two gluing bases 2 far away from each other are provided with second bolts 9; an end portion of the second bolt 9 extends into the corresponding driving groove 24; and the second bolt 9 is threadedly and hermetically connected with the gluing base 2.

Before gluing the two sides of the semi-finished product by the processing device, the first bolt 82 is screwed in an opposite direction to make the first bolt 82 far away from the rectangular bar 8 during screwing, so that the rectangular bar 8 is unlocked. Subsequently, the rectangular bar 8 is controlled to slide along the rectangular groove 28, the rectangular bar 8 may drive the connecting bar 81 to move during movement, the connecting bar 81 may drive the adjusting bar 7 to slide along the adjusting groove 27 during moment, the adjusting bar 7 can shield the gluing groove 21 after movement, the gluing groove 21 is shortened when the adjusting bar 7 approaches the glue box 3, and the gluing groove 21 will be lengthened when the adjusting bar 7 is far away from the glue box 3, so that the gluing groove 21 can be suitable for semi-finished products with different lengths, thus widening an application scope of the processing device. After completing the movement of the adjusting bar 7, the first bolt 82 is screwed in a forward direction to make the first bolt 82 abut against an outer wall of the rectangular bar 8, so that the rectangular bar 8 is locked, and then the adjusting bar 7 is also locked. The operator screw the second bolt 9 at the same time, the second bolt 9 may enter the driving groove 24 during screwing, and the end portion of the second bolt 9 abuts against the driving plate 5, so that a reset distance of the driving plate 5 under the elastic force of the second spring 53 is limited. By controlling a length of the second bolt 9 entering the driving groove 24, a movement range of the driving plate 5 in the driving groove 24 is changed, so that a single gluing amount in the gluing groove 21 is controlled, thus being suitable for requirements of different gluing amounts.

When the movement of the processing device is suspended and stopped for a period of time, the adjusting bar 7 may be controlled to completely shield the groove opening of the gluing groove 21, and the first bolt 82 is used to complete locking, so that the glue in the gluing groove 21 is out of contact with the air, and the residual glue is sealed to ensure the fluidity of the glue in the gluing base 2 and the glue box 3. In addition, a heating unit may be arranged in the gluing base for heating, so as to ensure the smoothness of the glue. In this embodiment, the length of the adjusting bar 7 is longer than that of the gluing groove 21.

Embodiment 7: if the glue overflows from the gluing groove 21 and makes contact with the semi-finished product as required during gluing, the glue in the gluing base 2 has good fluidity without air drying and low viscosity. After completing gluing, the glue adhered to the semi-finished product is air-dried, the fluidity of the glue can be reduced, and the viscosity of the glue can be increased.

The above show and describe the basic principles, main features and advantages of the present invention. Those skilled in the art should understand that the present invention is not limited by the above embodiments, the descriptions in the above embodiments and the specification only illustrate the principles of the present invention, the present invention may have various changes and improvements without departing from the spirit and scope of the present invention, and the changes and improvements fall within the scope sought to be protected by the present invention. The scope of protection claimed by the present invention is define by the appended claims and their equivalents.

We claim:

1. An improved false eyelash manufacturing process, wherein the process comprises the following steps of:

S1: obtaining an auxiliary film by a laser forming machine or a 3D printing film forming process;

S2: bending and shaping a tip part of an eyelash filament by a vacuum negative-pressure shaping method to obtain an eyelash filament with a curved tip part;

S3: adhering the eyelash filament in the S2 to an adhesive tape to form a half eyelash filament sheet, and then adhering two half eyelash filament sheets to form a whole eyelash filament sheet;

S4: adhering one side of the auxiliary film to one whole eyelash filament sheet, and adhering another whole eyelash filament sheet to another side of the auxiliary film to form a semi-finished product;

S5: gluing a position of the auxiliary film of the semi-finished product by a processing device; and S6: cutting off a redundant part of the glued semi-finished product by a cutting tool, and taking a remaining part as a finished false eyelash product.

2. The improved false eyelash manufacturing process according to claim 1, wherein, in the S1, the step of obtaining the auxiliary film by the laser forming machine, comprises:

S11: placing an auxiliary film raw material to be cut on a positioning table for fixing;

S12: utilizing a high-energy laser beam generated by a laser cutting machine in the laser forming machine, and cutting the auxiliary film raw material according to a preset cutting path;

S13: cutting the auxiliary film according to the preset cutting path by the laser cutting machine to obtain an auxiliary film in a required shape; and S14: carrying out quality inspection on the obtained auxiliary film.

3. The improved false eyelash manufacturing process according to claim 1, wherein, in the S1, the step of obtaining the auxiliary film by the 3D printing film forming process, comprises:

S1*a*: creating and importing a three-dimensional model of a required auxiliary film by computer software;

S1*b*: cutting the three-dimensional model of the auxiliary film into a thin layer with a standard thickness of the auxiliary film; and S1*c*: presetting a high-temperature resistant release film on a working table of a 3D printer, and then starting up the 3D printer to print layer by layer according to a number of thin layers to obtain the required auxiliary film.

4. The improved false eyelash manufacturing process according to claim 1, wherein a shape of the auxiliary film comprises a strip, a block, a flake and a filament.

5. The improved false eyelash manufacturing process according to claim 1, wherein, in the S2, the step of bending and shaping the tip part of the eyelash filament by the vacuum negative-pressure shaping method, comprises:

S21: placing the eyelash filament into a female die, wherein a bottom portion of the female die is provided with an air extraction port, and then pressing a male die above the female die to form a complete die;

S22: communicating an air extraction end of an air pump with the air extraction port at the bottom portion of the female die, and extracting air in an interior of the assembled die, so that the interior of the die is relatively vacuum, which enables the eyelash filament to be attached to a surface of the die; and S23: physically bending and shaping the tip part of the eyelash filament by utilizing shapes of the female die and the male die in a relative vacuum environment.

* * * * *